US005718380A

United States Patent [19]

Schorn et al.

[11] Patent Number: 5,718,380

[45] Date of Patent: Feb. 17, 1998

[54] SHOWER HEAD

[75] Inventors: Franz Schorn, Schiltach; Gerd Blessing, Obereschach, both of Germany

[73] Assignee: Hans Grohe GmbH & Co. KG, Germany

[21] Appl. No.: 508,927

[22] Filed: Jul. 28, 1995

[30] Foreign Application Priority Data

Aug. 13, 1994 [DE] Germany ..... 44 28 788.7
Mar. 16, 1995 [DE] Germany ..... 195 09 532.4

[51] Int. Cl.[6] ..... B05B 3/04; B05B 3/16; B05B 15/02

[52] U.S. Cl. ..... 239/117; 239/123; 239/381

[58] Field of Search ..... 239/104, 106, 239/114, 115, 116, 117, 123, 380, 381

[56] References Cited

U.S. PATENT DOCUMENTS

| | | | |
|---|---|---|---|
| 1,236,617 | 8/1917 | Speakman . | |
| 1,982,538 | 11/1934 | Reedy | 299/136 |
| 2,251,192 | 7/1941 | Krumsiek et al. | 239/117 |
| 4,018,385 | 4/1977 | Bruno | 239/381 |
| 4,330,089 | 5/1982 | Finkbeiner | 239/381 |
| 4,838,486 | 6/1989 | Finkbeiner | 239/117 |

FOREIGN PATENT DOCUMENTS

| | | |
|---|---|---|
| 0284801 | 10/1988 | European Pat. Off. . |
| 0591877 | 4/1994 | European Pat. Off. . |
| 0621081 | 10/1994 | European Pat. Off. . |
| PS377401 | 6/1923 | Germany . |
| PS711583 | 10/1941 | Germany . |
| PS804089 | 4/1951 | Germany . |
| PS909919 | 4/1954 | Germany . |
| 3707885 | 9/1988 | Germany . |
| 4039329 | 7/1991 | Germany . |
| 9310730 | 10/1993 | Germany . |
| 4233694 | 4/1994 | Germany . |
| 4308988 | 9/1994 | Germany . |
| 486295 | 7/1938 | United Kingdom . |
| 2210566 | 6/1989 | United Kingdom . |

OTHER PUBLICATIONS

German Search Report dated Dec. 6, 1994 from counterpart German priority patent application No. DE-P 44 28 788.7.
German Search Report dated Sep. 8, 1995 from parallel German patent application No. DE-195 09 532.4.

*Primary Examiner*—Andres Kashnikow
*Assistant Examiner*—Robin O. Evans
*Attorney, Agent, or Firm*—Eckert Seamans Cherin & Mellott

[57] ABSTRACT

A shower having a shower head and a jet disk with a plurality of jet exit openings contains a cleaning device, which within the shower head has for each jet exit opening a pin, which is insertable in and reextractable from the jet exit opening. For moving the pins of the cleaning device a turbine is provided, which is driven by the water flowing into the shower head.

17 Claims, 2 Drawing Sheets

SHOWER HEAD

Figure 1:
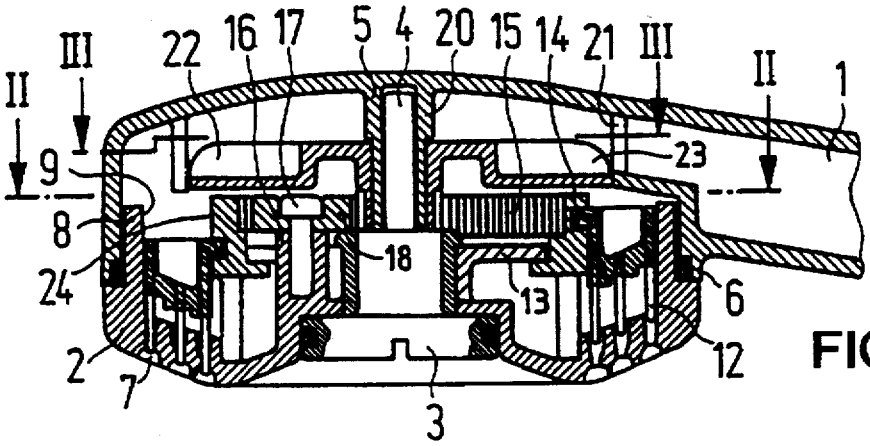

The invention relates to a shower having a shower head, a jet disk and a cleaning device.

A shower is already known (German patent 38 04 089), in which a plate is located within the shower head and has on its side facing the jet disk a number of pins corresponding to the number of jet exit openings. With the aid of a slider passed through the outer wall of the shower head the disk can be slid forward, so that the pins enter the jet exit openings and can there force through to the outside any lime deposits or other dirt and the like present. For carrying out cleaning this shower requires a deliberate action.

In a similar shower (U.S. Pat. No. 1,982,538) for operating a cleaning device a control grip is provided on the side of the shower head.

A shower head is also known (EP-B-284 801), in which a cleaning device having pins for piercing the jet exit openings is always operated if reversing takes place between two different shower jet types. In this case a deliberate operation of the cleaning device is no longer needed.

The problem of the invention is to provide a shower, which has an automatic cleaning of the jet exit openings, together with further advantages.

For solving this problem the invention proposes a shower head having the features given in claim 1. Further developments of the invention form the subject matter of subclaims.

Through the cleaning device drive driven by the flowing water said device is always operated as soon as the shower is used. By a corresponding speed reduction it is possible to ensure that the water pressure is adequate for operating the cleaning device. Through the periodic closing and reopening of the jet exit openings, even if the latter are not completely closed, additionally a massaging effect is brought about and it is ensured that the water consumption is reduced compared with a shower having equally large jet exit openings.

It can be provided that all the pins are simultaneously located at the same axial position and are consequently simultaneously moved. It is also possible to combine the pins into groups and then the groups are driven by the drive. It is also possible for the pins of at least two groups to have a different position in at least one drive position. This makes it possible to bring about a massaging action, which is noticed to a greater or better extent by the user. This also prevents all the jet exit openings being closed in any position of the drive.

According to the invention it can be provided that the pins are placed along at least one circle. The pins can be fixed, e.g. by injection moulding within the shower head to a ring element or partial ring elements, a circular shape being particularly appropriate for a drive.

For the displacement of the pins the drive can have a rotating curved guide for the pins. For example, the pins or the elements to which the pins are fixed can engage with a stud in a slot or groove of the rotating curved guide and the rotation of said curved guide then leads to an axial displacement of the pins and numerous different movement sequences can be brought about.

In particular, the curved guide can be given a tooth system, which is in operative connection with a turbine driven by the water.

According to the invention of several groups of pins only the pins of one group are located in the jet exit openings. In the case of calcareous water and long shower non-use periods, it can be ensured that despite a slight caking of the pins the force provided by the drive is still adequate for releasing the cleaning device.

According to an advantageous development of the invention when the water supply is switched off all pins are disengaged from the jet exit openings. This can be brought about by a lifting drive operable by spring action. The spring tension is overcome by the water pressure when the water supply is switched on.

According to the invention the groups can extend over in each case a circular arc and adjacent groups take up different axial positions of the pins. In this way the massaging action can migrate along the circular arcs.

It is also or simultaneously possible for the pins to be arranged along at least two concentric circles. Here again the pins of two adjacent circles can be differently positioned, so that there is a massaging action from the inside to the outside and back again. Advantageously combinations of these two movements are obviously possible.

Normally the constant cleaning and optionally the massaging action through the drive is brought about by the water flow. However, if the shower is not in use for a long time, e.g. during a long period of absence, then the possibility exists of a line deposit between the pins and the jet exit openings making the cleaning device so difficult to operate that it does not start up again during normal shower operation. By operating the manual device before or during showering this sticking or difficult action can be overcome. By manual action a greater force is available than could be provided by the water pressure alone. As soon as the cleaning device has been released again and the difficult action overcome, then once again the water-operated cleaning device can be used.

In particular, the manual operating device can be operated by the action of the user, e.g. by rotating the jet disk.

If the flow-operated drive is particularly easy to operate, a risk exists that the drive will rotate back on operating the manual release device. According to a further development, this can be prevented by providing a barrier or stop mechanism for preventing such a return movement. Such a barrier can in particular be positioned between a rotary part and a non-joint rotating part.

According to the invention the barrier can have at least one, more particularly resilient tongue shaped onto one shower head part and which resiliently engages on the other shower head part and which has at least one stop shoulder running transversely to the rotation direction. During normal rotation the resilient tongue in each case slides over the other part and only in the case of a rotation in the opposite direction is there any blocking of the device. This means that the manual operating device is only operated by a rotation of e.g. the jet disk in one rotation direction.

According to the invention the stop shoulder is formed by the end of a pocket which is wedge-shaped in the rotation direction in one of the two shower head parts. This pocket can be so construction that on carrying out the blocking action the resilient tongue is laterally surrounded with a limited clearance, so that it cannot give way laterally and cannot break off.

For the displacement of the pins the drive can have a rotary curved guide for them. In this case preferably the barrier is provided between said curved guide and a shower head part, particularly a distributor plate.

Further features, details and advantages can be gathered from the claims, whose wording is made by reference into part of the description, the following description of a preferred embodiment and the attached drawings, wherein show:

FIG. 1 A section through the shower head of a hand shower.

Figure 2:
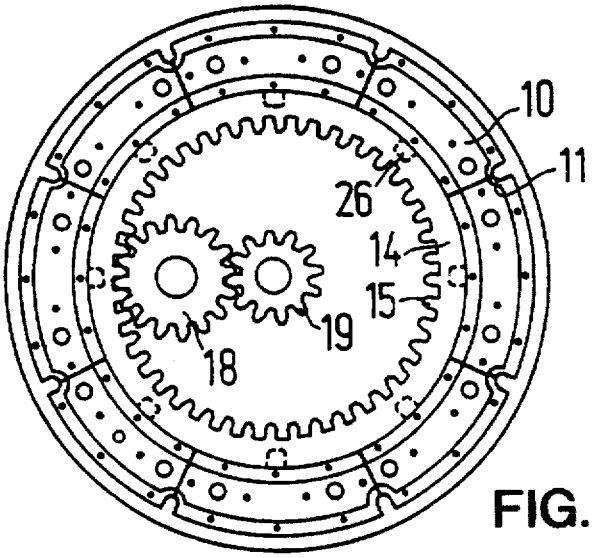

FIG. 2 A section roughly along line II—II of FIG. 1.

Figure 3:
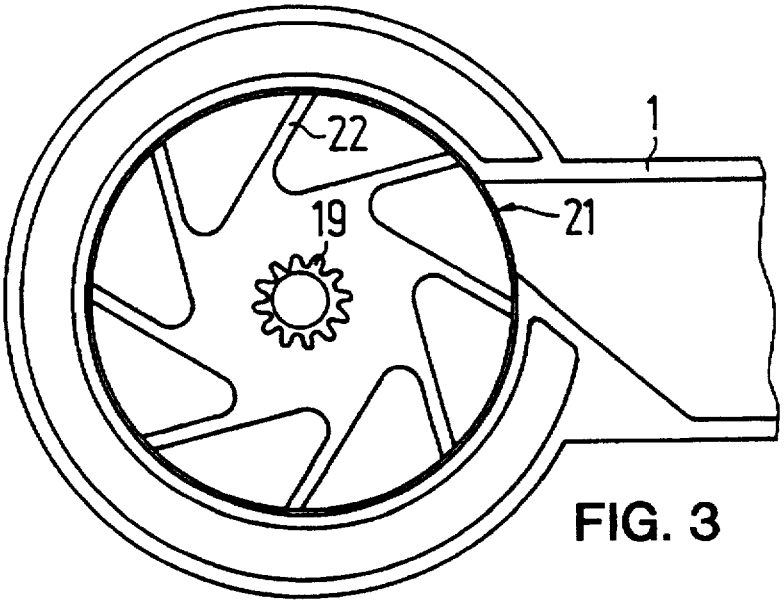

FIG. 3 A section roughly along line III—III in FIG. 1.

Figure 4A:
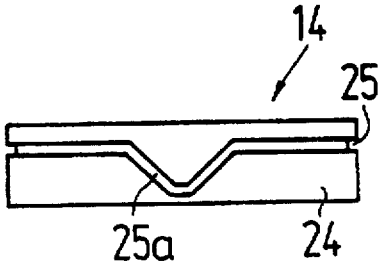
Figure 4B:
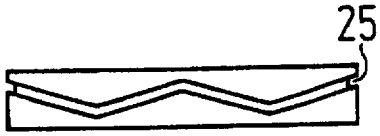

FIGS. 4*a* and 4*b* The developed projection of the outside view of a curved guide for driving the cleaning device.

Figure 5:
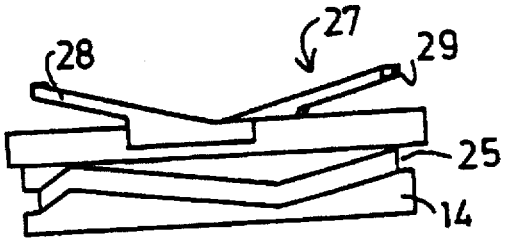

FIG. 5 A side view of a ring element having a curved guide for the cleaning device in a second embodiment.

Figure 6:
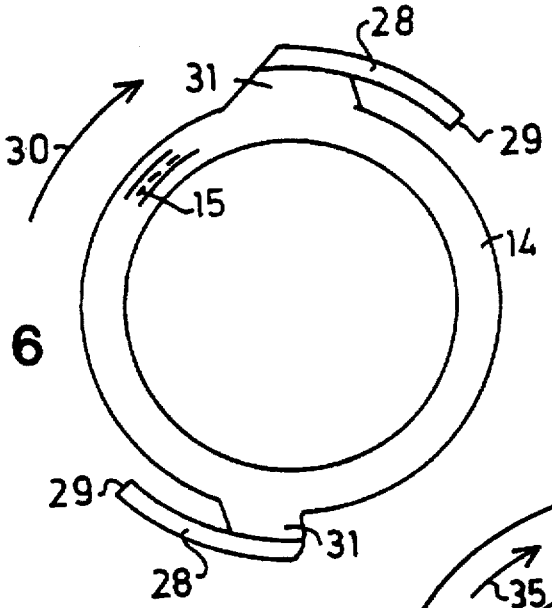

FIG. 6 A plan view of the ring element of FIG. 5 in simplified form.

Figure 7:
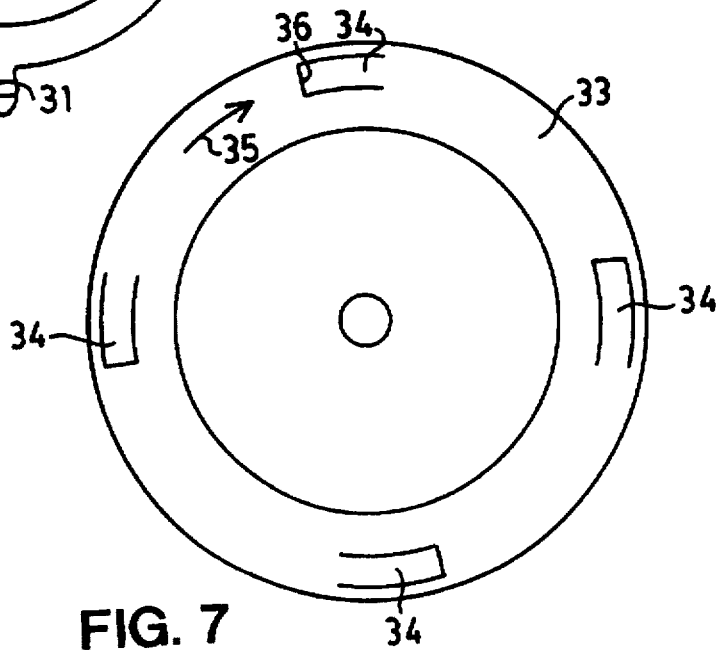

FIG. 7 is a bottom view of a distributer plate.

Figure 8:
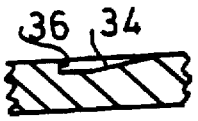

FIG. 8 A partial section through the distributor plate in the circumferential direction.

The hand shower head shown in FIG. 1 is located at the end of a hollow grip 1. The water passes into the shower head through said hollow grip 1. On the underside in FIG. 1 a jet exit disk 2 is fixed to the shower head with the aid of a central screw 3. The thread 4 of the screw 3 engages in a bush 5 formed in the shower head and which has an internal thread. The jet exit disk 2 is sealed along its circumference with respect to the shower head casing with the aid of a seal or packing 6. The jet exit disk 2 contains three rows of jet exit openings 7 extending along three concentric circles. The jet exit disk 2 has a cylindrical skirt 8 directed into the interior of the shower head. The inside 9 of the skirt 8 forms a cylindrical surface.

The outer faces of a total of eight segments 10 engage on said cylindrical surface 9 and extend circumferentially over in each case an octant. The identically constructed segments are fixed in their circumferential position by inwardly directed, roughly semicircular projections 11 on the inner wall 9 of the skirt 8 of the jet disk 2. The segments 10 can slide in a direction perpendicular to the jet disk 2, i.e. in axial direction along the cylindrical surface 9. On their side facing the jet disk 2 they contain individual pins 12. The pins 12 are arranged in an axial extension of the jet exit openings 7. With each jet exit opening 7 is associated a pin 12 on a segment 10.

On the jet disk 2 is fixed on its side directed into the interior of the shower head a planar plate 13, which is perpendicular to the rotation axis of the screw 3. On said plate 13 is held in rotary manner a ring element 14, which can consequently rotate around the screw 3. The ring element 14 has on its inside a tooth system 15.

Laterally alongside the screw 3 is mounted in rotary manner on the inside of the jet disk 2 a pinion 18 with the aid of a screw 17 engaging in a bush 16. The pinion 18 meshes on the one hand with the tooth system 15 of the ring element 14 and on the other with a further pinion 19. The pinion 19 is formed by the external tooth system of a bearing bushing 20 of a turbine wheel 21. The turbine wheel 21 with its bearing bushing 20 is mounted in rotary manner on the shower head bush 5. Its axial displaceability is limited by corresponding shoulders on the bush 5 or on the screw 3. On its side remote from the jet disk 2 the turbine wheel 21 has individual, sloping turbine blades 22.

The water passes from the hollow grip through an opening 23 into the interior of the shower head. The opening is so positioned that the water strikes the blades 22 of the turbine wheel 21. It flows in sloping manner into the shower head, so that it strikes the blades 22 and the turbine wheel 21 is rotated by the inflowing water. The pinion 19 shaped in one piece onto the turbine wheel 21 rotates the pinion 18 located in the jet disk 2 and said pinion in turn rotates the ring element 14.

In the cylindrical jacket outer surface 24 of the ring element 14 is formed a closed groove 25 extending over the entire circumference. Each segment 10 has on its circular arc inside a roughly centrally positioned stud 26, which engages in said groove 25. On rotating the ring element with respect to the segments 10 left standing in the circumferential direction, the studs 26 consequently follow the shape of the groove.

FIG. 4*a* shows a possible shape of the groove 25 in the cylindrical jacket outer surface 24 of a ring element 14. The ring element 14 is shown in the same orientation as in FIG. 1, so that in FIG. 4*a* the jet disk must be considered at the bottom. The groove 25 runs over most of the circumference parallel to the planar front face of the ring element 14 and contains only one portion, where the groove approaches in V-shaped or U-shaped manner the lower front face of the ring element 14. In this portion 25*a* the particular associated segment 10 is displaced towards the jet disk 2, so that the pins 12 penetrate the jet exit openings 7. This is shown to the left in FIG. 1. During the remaining position of the ring element the segments are displaced upwards, so that the pins 12 are disengaged from the jet exit opening 7. Thus, the curved shape of the groove 25 of FIG. 4*a* means that only a single segment 10 with its pins is displaced in such a way that said pins engage in the jet exit opening 7.

In the shape of the groove 25 shown in FIG. 4*b* there is a constant movement up and down of the pins 12 into and out of the jet exit openings 7.

In the embodiment of FIG. 1 the pins 12 are combined into groups, each group of pins being formed on a segment 10. These segments 10 can be individually moved by the curved guide. In the represented embodiment a single groove 25 is used for moving all the segments. It is obviously also possible to place on the outer surface 24 of the ring element several grooves and the segments can engage with their studs 26 in different grooves. This brings about a greater degree of freedom with respect to possible movements.

It is also possible in place of the combination of three concentric arcs of pins 12, to in each case combine the pins of an arc or a closed circle so as to form a group, so that then the pins of the three different concentric circles can be differently moved. This can e.g. be brought about in that the pins of the outermost circle of jet exit openings would engage with an individual ring element in another groove in FIG. 1 located above the groove 25.

By corresponding dimensioning of the tooth systems 15, 18 and 19 it can be ensured that a cleaning action is obtained with the normal water pressure.

Onto the outside of the ring element 14 in the embodiment of FIGS. 5 to 8 is shaped a ratchet 27, which is resiliently constructed and resiliently engages with its end on one part 21 of the shower head. This shower head part 21 has stop faces, which cannot be seen in FIG. 1 and which are at right angles to the circumferential direction and on which can engage the ratchet 27.

The ratchet 27 is in the form of a resilient tongue 28 and at two diametrically displaced points of the ring element 14 is shaped onto the top of the latter. The resilient tongues 28 are located radially somewhat further outwards than the cylindrical outer surface of the ring element. They extend under an angle of approximately 15° with respect to the plane of the top of the ring element and are given a relatively thin and narrow construction. They terminate in a planar end face 29, which runs perpendicular to the plane of the top of the ring element 14 and perpendicular to the circumferential direction represented by the arrow 30. FIG. 6 is a view from above of the ring element 14 and the tooth system 15 of FIGS. 1 and 2 is only intimated here. The two ratchets are shaped onto the ends of radial projections 31 and run along a circular arc.

The counterelement with which the resilient tongues 28 cooperate for forming a barrier, is a distributor plate 32 shown in FIG. 7 and which is not present in the embodiment according to FIG. 1. In the embodiment according to FIG. 1 a corresponding construction would be provided on the shower part 21.

The underside of the distributor plate 32 contains a smooth, wide, circular cylindrical ring 33, which has individual pocket-like depressions 34, which are located at the radial point where also the resilient tongues 28 are positioned. The width of the pocket-like recesses 34 measured in the radial direction is somewhat greater than the corresponding width of the resilient tongues 28, so that when the latter are located in the recesses 34 they are guided by the side walls.

During normal operation of the cleaning device by the water pressure the arrangement is such that the ring element 14 rotates in the opposite direction to the arrow 30 in FIG. 6. Thus, the resilient tongues move in such a way that their front faces 29 are positioned at the rear in the rotation direction. Thus, in the direction of the arrow 35 in FIG. 7 the tongues 28 can slide over the ring 33 and the ends 29 then drop into the recess 34.

If a cleaning device which has become difficult to operate or immovable has to be released by hand, then manual rotation takes place on the shower jet disk 2 of FIG. 1. If the pins 12 are located and fixed in the jet exit openings 7, this rotation leads to a joint rotation of the ring element 14. This is possible, because the turbine wheel 22 is in no way prevented from rotating, not even if there is a water pressure thereon.

The shower head is now moved in such a way that the ring element 14 is rotated in the direction of the arrow 30 in FIG. 6. Therefore now the front faces 29 of the resilient tongue 28 are at the front in the rotation direction and slide over the ring 33 into the depressions 34 until they engage on the front faces 36 thereof, which prevents a further rotation of the ring element 14. During further rotation of the jet disk the studs 26 are displaced along the groove 25, which leads to a force component in the longitudinal direction of the pins 12 and consequently to a disengagement from the jet exit openings. This leads to the release of the cleaning device, so that it can now again be operated by the flowing water.

In a preferred embodiment four pocket like depressions 34 having front faces 36 (stop shoulders) are uniformly distributed over the circumference of the distributer plate 33 as shown in FIG. 7.

We claim:

1. Shower having a shower head, a jet disk with a plurality of jet exit openings, a water passage leading to the jet disk, a cleaning device having a plurality of pins arranged in an axial extension of the jet exit openings and which can be moved into and out of said openings, a drive having a rotary curved guide for the pins and having a tooth system in operative connection with a turbine of the drive, the turbine being drivable by water flowing to the jet exit openings thereby driving the pins in a reciprocating manner.

2. Shower according to claim 1, wherein the pins are combined into pin groups drivable by the drive.

3. Shower according to claim 2, wherein the pins of two groups have in a specific position of the drive a different position.

4. Shower according to claim 1, wherein the pins are arranged along a circle.

5. Shower according to claim 2, wherein with respect to several groups of pins, only the pins of one group are located in the jet exit openings.

6. Shower according to claim 1, wherein when the water passage is switched off all the pins are disengaged from the jet exit openings.

7. Shower according to claim 2, wherein the groups of pins extend over in each case one circular arc and adjacent groups assume different positions in the movement direction.

8. Shower according to claim 1, wherein the pins are arranged along two concentric circles.

9. Shower according to claim 8, wherein the pins of adjacent circles belong to different groups of pins.

10. Shower according to claim 1 with an additional, manually operable device for operating the cleaning device.

11. Shower according to claim 10, wherein the manually operable device is operable by action on the jet disk.

12. Shower having a shower head, a jet disk with a plurality of jet exit openings a water passage leading to the jet disk, a cleaning device having a plurality of pins arranged in an axial extension of the jet exit openings and which can be moved into and out of said openings, a drive, which is drivable by water flowing to the jet exit openings and drives the pins in a reciprocating manner, wherein the jet disk is manually operable to operate the cleaning device and wherein the drive has a barrier for preventing a rearward movement of the drive and which is located between a rotating part and a fixed part of the shower.

13. Shower according to claim 12, wherein the barrier has a resilient tongue placed on one shower head part and which resiliently engages on the other shower head part and has a stop shoulder running transversely to the rotation direction.

14. Shower according to claim 12, wherein the stop shoulder is formed by the end of a pocket-like recess in the shower head part and which is wedge-shaped in the rotation direction.

15. Shower according to claim 12, wherein the barrier is provided between a rotary curved guide for moving the pins and a shower head part.

16. Shower according to claim 13, wherein two resilient tongues are shaped in diametral manner on the curved guide.

17. Shower according to claim 13, wherein four stop shoulders are uniformly distributed over the circumference.

* * * * *